United States Patent [19]

Heitmann

[11] 3,955,481

[45] May 11, 1976

[54] APPARATUS FOR ADHERING TRAVELING STRIP MATERIAL TO FOLDED BLANK BOXES

[75] Inventor: Günter Heitmann, Lubeck, Germany

[73] Assignee: Genco International, Hamburg, Germany

[22] Filed: Sept. 16, 1974

[21] Appl. No.: 506,533

[30] Foreign Application Priority Data

Sept. 14, 1973 Germany ..... 2346368

[52] U.S. Cl. ..... 93/36.9; 53/137; 93/56 R; 156/521; 156/578

[51] Int. Cl.[2] ..... B31B 1/72

[58] Field of Search ..... 93/36.9, 41, 56 R; 53/137; 156/521, 578, 519

[56] References Cited

UNITED STATES PATENTS

| | | | |
|---|---|---|---|
| 2,760,414 | 8/1956 | Cornock et al. | 156/521 X |
| 3,300,363 | 1/1967 | Burroughs | 156/521 |
| 3,346,433 | 10/1967 | Lopez | 156/521 X |
| 3,654,038 | 4/1972 | Hottendorf | 93/36.9 X |

*Primary Examiner*—James F. Coan
*Attorney, Agent, or Firm*—Edwin E. Greigg

[57] ABSTRACT

An apparatus for adhering strips of predetermined length that previously have been severed from a running web of material to folded blank boxes which includes cutting the strips to length, advancing them by a conveyor seriatim past an adhesive activation station and then coordinating the leading edge of the strip with the arrival of the folded blank box at a roller assembly station where the strip is secured to the box and then discharged.

8 Claims, 9 Drawing Figures

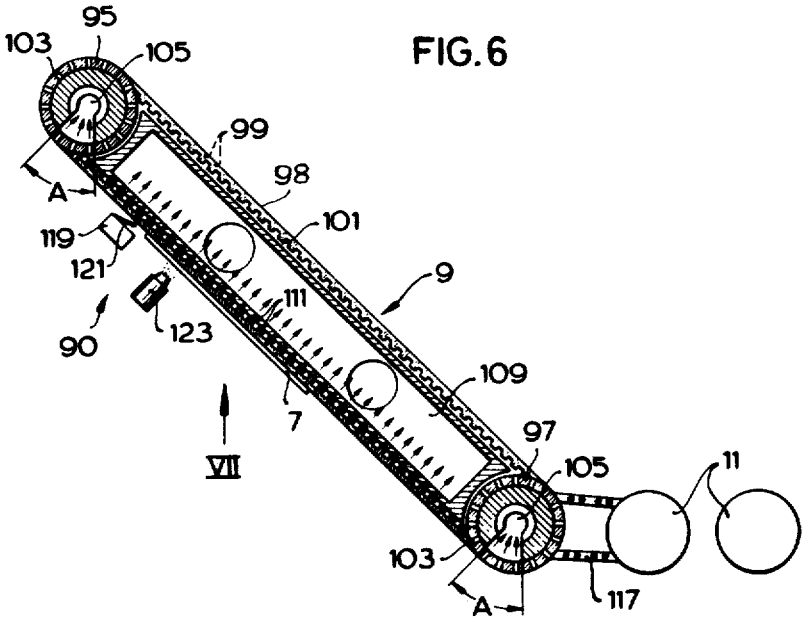
FIG. 6
FIG. 7
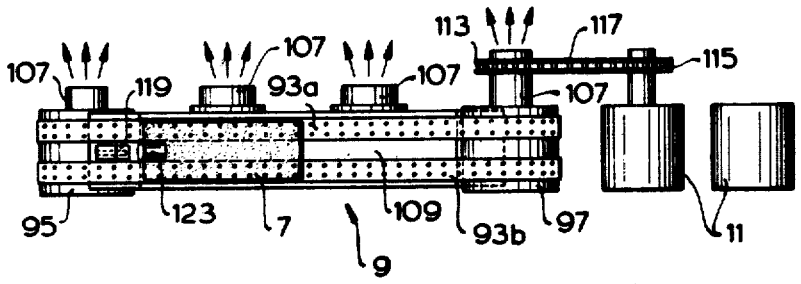

APPARATUS FOR ADHERING TRAVELING STRIP MATERIAL TO FOLDED BLANK BOXES

BACKGROUND OF THE INVENTION

The invention relates to a device for the automatic gluing of adhesive strips to boxes or cases, in particular to slit and folded corrugated board cases, where the adhesive strip is unrolled from a supply roll, cut to the desired length and taken to the gluing station.

In the manufacture of corrugated board cases, it is customary at present to effect the application of adhesive strips by a separate machine unit. These machine units are controlled independently of the printing and slitting machine, which precedes the gluing station machine unit, as does the machine for folding into sections. The length of the adhesive strip is controlled by means of two adjustable limit switches, by means of which the position of the adhesive strip and its length are controlled. The adhesive strip applying machine operates intermittently, which means that the feed of the adhesive strip is halted and then restored to the speed of the machine. Severance of the adhesive strip is effected by means of a movable blade, which is controlled by the corresponding operation of the limit switches. At high working speeds, very great inaccuracies are the result of this method of operation.

SUMMARY OF THE INVENTION

The present invention seeks to provide a device in which the preparation of the lengths of adhesive strip for application to corrugated board cases and the feed of the corrugated board cases to which the lengths of adhesive strip are to be applied, are precisely coordinated.

In accordance with the invention, in a device of the type mentioned, the uncut, continuously fed adhesive strip is severed by means of a cutter cylinder coupled to the case-making machine and passed to a conveyor device for the cut lengths, the cut-off length of adhesive strip being transferrable to a gluing path and advancing past a moistening mechanism in the region of the strip conveyor device.

By means of this coupling of the case-making machine with a cutter cylinder for the advancing adhesive strip, a fixed coordination is provided between the manufacture of the case and the supply and preparation of the adhesive strip in a ready-to-apply state. This ensures accurate gluing.

According to a further preferred embodiment of the invention, the cutter cylinder is provided with a cutting blade, which on every rotation of the roller produces a predetermined length of adhesive strip. The peripheral speed of the cutter cylinder bears an adjustable ratio to the peripheral speed of a slit cutter roller of the case-making machine. The ratio between the peripheral speeds can be adjusted by means of a speed changing mechanism. The severing of portions of adhesive strip can take place either at the speed of the slitting machine or via the speed changing mechanism at a speed related to that of the machine.

With the aid of the device according to the invention, the adhesive strip is therefore driven continuously via a variable mechanism at a speed which is variable in relation to that of the case-making machine. By varying the relative speed, a longer or shorter adhesive strip is separated from the supply roll. Moreover, the rotating blade for the length of adhesive strip is controlled in register by the slotted shaft of the previously connected printing and slitting machine, i.e. on each rotation of the main part of the slitting blade, the cutter roller for the severing of the adhesive strip also performs a revolution. According to the variation of the speed of travel of the adhesive strip, the latter becomes longer or shorter.

According to a further preferred embodiment of the invention, a conveyor roller located in front of the cutter roller of its counter roller can be displaced in the event of an operational fault. By this displacement, the strip advanced from the supply roll is released and therefore no longer conveyed. However, so that the adhesive strip does not continue to run, the feed is stopped by means of a brake device on the displacement of one of the rolls. For this purpose, a brake device is provided consisting of a pressure roller and a brake shoe actuated by a control unit which can be arranged on the pressure roller. The continuous feed of strip thus ceases as soon as required owing to a fault.

According to a further preferred embodiment of the invention, the strip conveyor device is a vacuum conveyor, having a conveyor belt on to which lengths of adhesive strip can be carried by suction and which accelerates the lengths of adhesive strip to the rate of feed of the cases, which are passed from the slitting and folding device preparatory to being glued.

The perforated endless conveyor belt runs around radially-perforated driver rollers, between which there is an evacuated suction box. The vacuum box and the interior of the driving rollers are connected to a source of vacuum. This source of vacuum can be a fan, for instance. With the help of the strip conveyor device, the severed portions of strip are, however, brought up to the folded cases which are supplied seriatim to the point of assembly. During conveyance along the conveyor belt, the lengths of strip are also prepared for gluing, however. For this reason, in the region of the strip conveyor device, the moistening mechanism is arranged and this includes a contact element actuated by the adhesive strip, which operates a nozzle device for moistening the adhesive strip. If the adhesive strip being fed is provided with moistenable adhesive, the moistening nozzles are only required to spray water or to the adhesive strip. If, however, the adhesive strip is not of the pre-gummed type, the moistening nozzles have to spray on a wet adhesive on the strip.

After lengths of adhesive strip have been severed by means of the cutter roller, the individual severed adhesive strips are therefore raised via a vacuum belt to the speed of the machine, moistened and then applied in register on the oncoming folded and aligned corrugated board cases. Since the initial position of the adhesive strip on the corrugated board case is dependent on the end of the first slit (the latter is produced by the printing and slitting machine connected in front), the position of the adhesive strip on correcting the slitting blade is automatically corrected as well, owing to the positive connection between the rotating blade roller and the slotted shaft. In the case of operation by skip feed or extended slitting (trip-feed), which means that on every second or third rotation of the slitting blade shaft a corrugated board case is inserted, via a speed changing mechanism, the blade roller is given a speed which is relative to that of the slitting machine.

According to a further development of the invention having its own inventive property, when an adhesive strip free of adhesive material is supplied, there are provided applicator devices for applying a hot-melting adhesive and a wetted glue. These devices are disposed along the conveyor path of the as yet adhesive-free strip segment and in the region of the strip conveyor apparatus, one behind the other and they are in addition to the contact member actuated by the adhesive strip. The applicator device for the hot melt adhesive applies it in patches, while the applicator device for the wet adhesive coats the whole adhesive strip with moist adhesive. On applying the adhesive strip to the corrugated board case, the hot melt adhesive thus brings about an immediate gluing effect so as to cause positive attachment, while the wet adhesive brings about full adhesion subsequently. The combined use of a hot melt adhesive and a wet adhesive avoids the disadvantages which arise from the sole use of a wet adhesive. These reside in the fact that a predetermined dry length and straightening station are needed, while the wet adhesive sets. A special dry length and straightening station is dispensed with in the case of the combined use of hot melt and wet adhesives.

After moistening the lengths of adhesive strip, these are rolled between the pairs of rollers on to the folded corrugated board cases. According to a further preferred embodiment of the invention, the pairs of coating rollers are driven by the same driving part of the case slitting machine which also drives the conveyor roller and the cutter roller.

In particular with the use of the primarily adhesive-free adhesive strip, good color agreement is brought about between the adhesive strip and the corrugated board case.

BRIEF DESCRIPTION OF THE DRAWING

The invention is further explained below by means of the practical embodiments illustrated by way of example in the accompanying drawings, wherein:

FIG. 6 shows a side view of the vacuum conveyor device, partly in broken-away view;

FIG. 7 shows a view from the bottom on the line VII of the opening in the device according to FIG. 6;

DETAILED DESCRIPTION OF THE EXEMPLARY EMBODIMENTS

Figure 1:
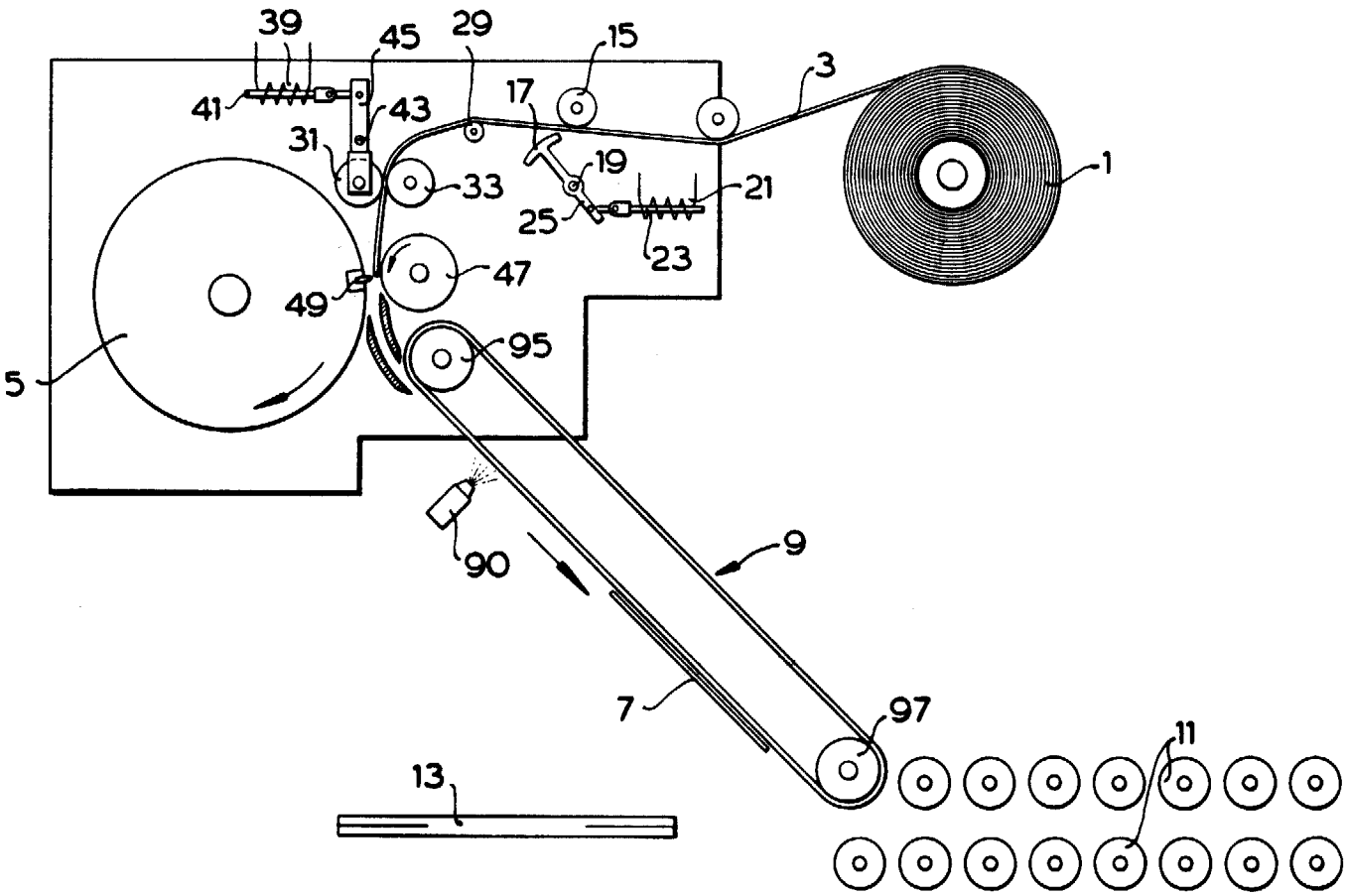
FIG. 1 shows the general construction of the device according to the invention with conveyor and cutter rollers for an adhesive strip driven by the case-making machine, severed portions of the strip being passed via a vacuum conveyor device to a coating roll train.

The general structure of the apparatus, which is reproduced diagrammatically in FIG. 1, includes a supply roller 1 for an adhesive strip 3, which is cut by a blade carried by roller 5 into adhesive strip portions 7 of predetermined length which are passed via a vacuum conveyor device 9 to a roller coating trackway comprising rollers 11. Besides the adhesive strip portion 7, a corrugated board case 13 which is to be glued is suitably transported up to and is introduced between the rollers 11.

Figure 2:
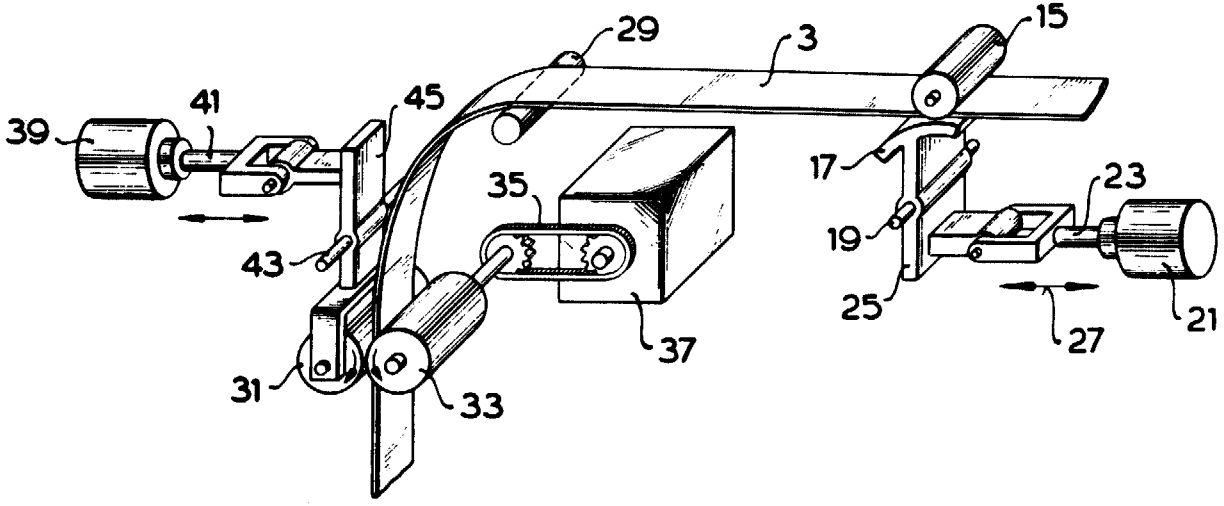
FIG. 2 shows diagrammatically the conveyor and brake device for the adhesive strip supplied from a roller.

FIG. 2 shows more precise details of the feed of the adhesive strip tape to the associated blade roller 5. After the adhesive strip tape 3 has been unwound from the roller 1, and this is associated with a braking mechanism the operation of which will be explained in greater detail hereinafter, the tape 3 passes between an idler roller 15 and a brake shoe 17. The brake shoe 17 is pivotable about an axis 19 and can be pivoted with the help of a control element 21, for instance, a magnet armature so that the shoe can clamp the tape 3 between its upper surface and the roller 15. For this purpose, the control element 21 includes a rod 23 which is associated with the brake shoe holder 25, thus making it possible to reciprocate the brake shoe in either direction as indicated by the double arrow 27.

During normal operation, the brake shoe 17 is pivoted out of the path of movement of the tape 3. The operation of the brake shoe is suitably coordinated by electrical circuitry, with the box making machine and mechanical elements and is only pulled into the braking position when the flow of production of the corrugated board cases has been interrupted for any reason as will be well-understood by those skilled in this art. In the braked position, the brake shoe 17 presses against the idler roller 15, so that the tape cannot be moved any further.

With properly running production, the tape 3 travels between the brake device 17 and roll 15 over a guide roller 29 and then between a free-running transport roller 31 and a driven transport roller 33.

The transport roller 33 is driven through a chain drive 35 by a regulated drive means 37. The speed of rotation of the transport roller 33 governs the rate of delivery of the adhesive strip tape 3.

The transport of the adhesive strip tape 3 between the idler roller 31 and driven roller 33 can be interrupted if the control element 39, for instance, a magnet armature, is moved forwardly at which time the adjustment rod 41, rotates the idler roller 31 about the pivot bearing 43.

Figure 3:
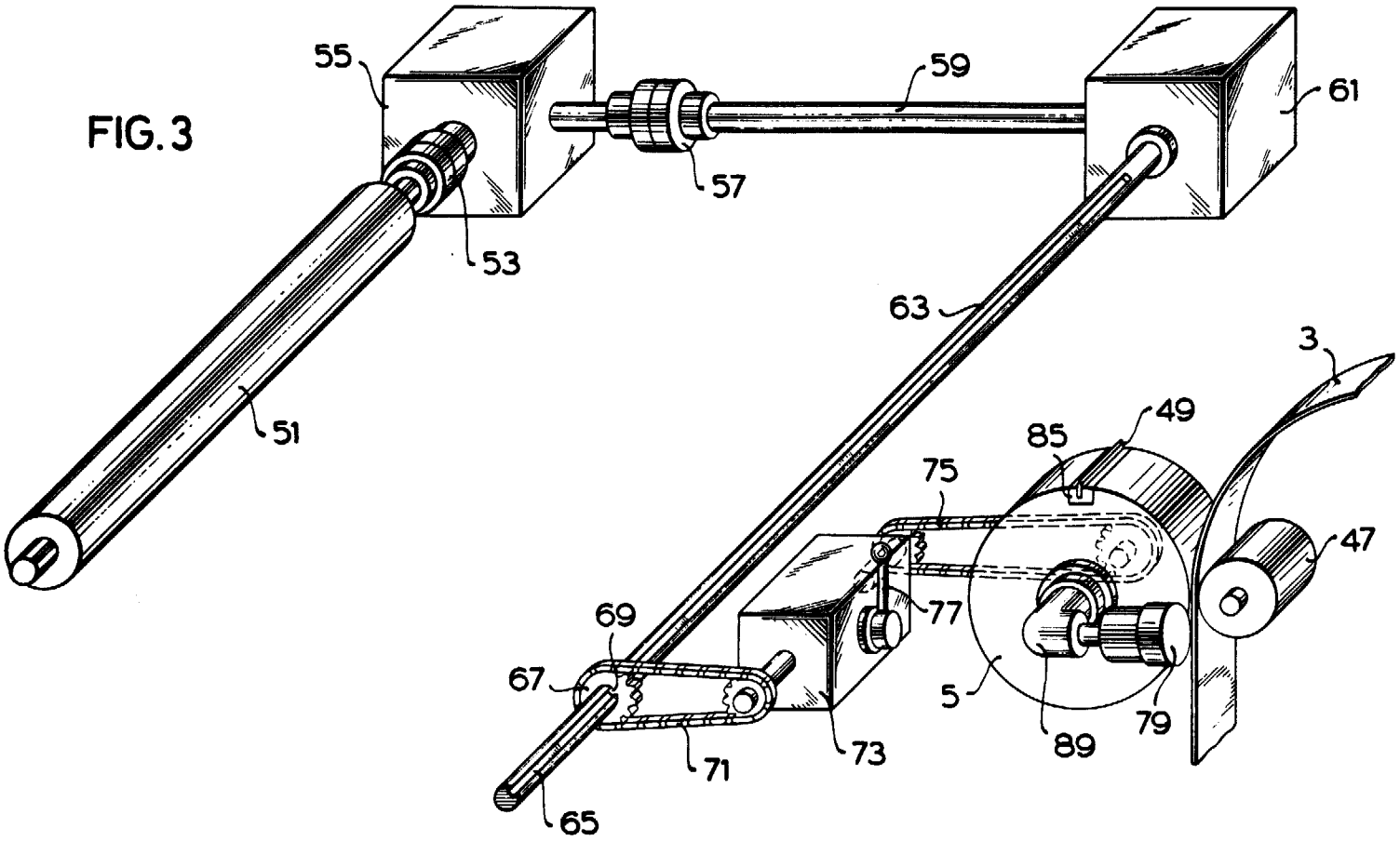
FIG. 3 shows the non-positive connection between the case-making machine and the cutter roller.

Continuing on past the transport rollers 31 and 33, the adhesive strip tape 3 then arrives, as shown in FIG. 3, between the roller 5 provided with cutter 49 and a counter blade wheel 47. The roller 5, which is provided on its peripheral surface with a cutter 49 running parallel to the shaft axis, is driven by a slit cutter shaft 51 of the printing and slitting machine for making the corrugated board cases. For this purpose, the slit cutter shaft 51 drives a transmission shaft 59 via a universal joint 53 and an angular drive mechanism 55 via a further universal joint 57. The shaft 59 in turn via a further angular drive mechanism 61, drives a shaft 63. The shaft 63 is made of a hardened steel and has a V-shaped groove 65 extending substantially throughout its length. The length of the V-groove or keyway 65 corresponds to the effective width of the machine. A drive means 67 is arranged on the shaft 63 and is provided with a lug 69 to be received in the keyway groove 65. The drive means 67 thus always rotates with the shaft 63 and, through a belt or chain drive 71, operates a shift mechanism 73. The drive means 67, together with the whole of the treatment device for the adhesive strip, can be adjusted throughout the effective width of the casemanufacturing machine. At the same time, the roller 5 provided with the cutter is driven in register with the slit cutter shaft 51 and the slit strip can be properly glued to the appropriate place on a corrugated board case where this is desired. The shift mechanism 73, which drives the cutter carrying the wheel 5 via a further V-belt or chain drive 75, can transmit three speeds of rotation to the cutter roller 5 by means of a shift lever 77. The selected speed of rotation of the cutter roller 5 depends on whether the printing and slitting machine is operated according to the trade term "skip feed" or "trip feed". Skip feed or trip feed means that, on every second or third rotation of the slit cutter shaft 51, a corrugated board case is inserted in the gluing path. Via the shift lever 77, the true-to-register peripheral speed of the cutter roller 5 is switched on. Through a register on the printing and slitting machine, the position of the slit part which is on the slit cutter shaft 51 can be adjusted in relation to the zero position. In the same ratio, through the drive described, the cutter 49 is adjusted in relation to the cutting position. In order to be able to effect corrections on the cutter roller during production, a register motor 79 is associated with the cutter roller 5. Through this motor 79, the position of the blade 49 can be corrected in terms of millimeters.

Figure 4:
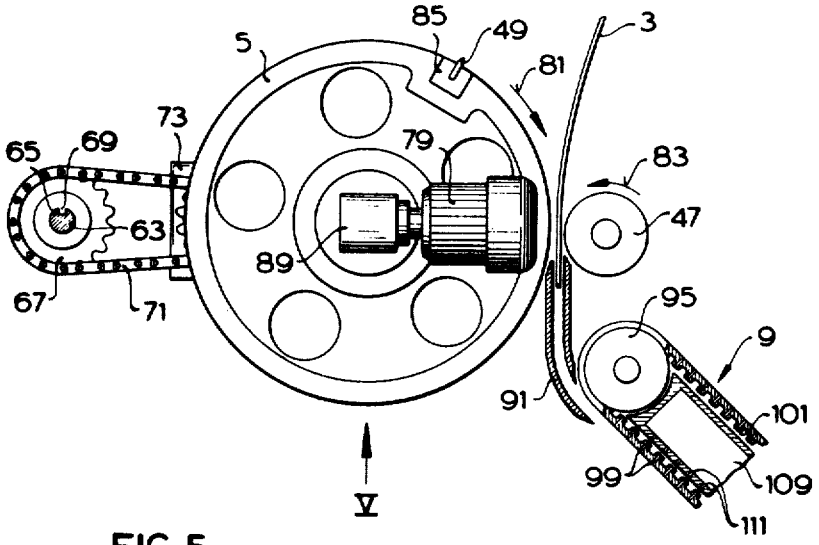
FIG. 4 shows a side view of the cutter roller with a part of the following vacuum conveyor device.
Figure 5:
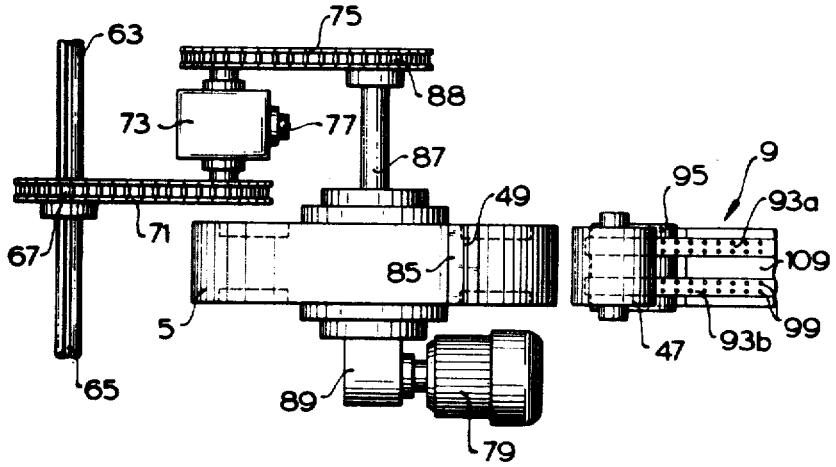
FIG. 5 shows a view from the bottom on the line V of the opening in the device according to FIG. 4.

FIGS. 4 and 5 represent details of the blade roller 5, the counter blade wheel 47 and the beginning of the vacuum delivery device. The cutter roller 5 and the counter cutter roller 47 run in the directions shown in FIG. 4 by the arrows 81 and 83 and also at the same peripheral speed. The counter cutter wheel 47 is made of a hardened steel or of a steel roller coated with a plastic material. On the other hand, the cutter roller 5 may consist for instance of aluminum. The cutter 49 is then held in the main part of the wheel by means of an insert 85. The adjustment of the cutter roller 5 in relation to its drive shaft 87, which rotates via the train of gears 71/75 and the drive gear 88 flanged to it in register with the slit cutter shaft 51, is effected by means of the motor 79 via an angle gear 89.

FIGS. 6 and 7 show the vacuum conveyor device 9 together with a moistening mechanism 90. The adhesive strip 3 or 7 in this case is provided with an adhesive which is made tacky by spraying with water. The portion of the adhesive strip 7 which is severed by means of the cutter roller 5 from the adhesive strip tape 3 is steered by a guide rail 91 and is directed thereby on to two conveyor belts **93*a* and 93*b*. The two conveyor belts run parallel to one another via drive rollers 95, 97. The conveyor belts 93*a* and 93*b* are perforated and have gear teeth 101 on the inner side away from the outer conveyor surface. The holes in the conveyor belts 93*a* and 93*b* are denoted by 99. The hollow drive rollers 95 and 97 are also provided with radial holes 103. If now the inner spaces 105 of the drive rollers 95 and 97 are connected via suction connections 107 (FIG. 7) to a vacuum pump, air in spaces 105 is withdrawn through the holes 103 and a portion of adhesive strip running on the zones A of the drive rollers is drawn on to the drive rollers. The space between the conveyor belts 93*a* and 93*b* and the drive rollers 95 and 97 is occupied with a box 109, which is also perforated on its lower surface and forms a supporting face for the conveyor belts 93*a* and 93*b*. This box 109 is also provided with suction connectors 107 which can be connected to a vacuum device like the suction connectors of a fan. For this reason, through the holes 99 in the conveyor belts and the holes 111 in the box 109 in the zone of the lower path of movement of the conveyor belts air is withdrawn from the interior of the box 109. The portion of adhesive strip 7 is therefore transported, adhering to the conveyor belts, from the upper drive roller 95 to the lower drive roller 97 free from slip. In this way, the portion of the adhesive strip 7 is accelerated to the gluing speed. The position of the suction holes 103 in the drive rollers 95 and 97 is adjustable in order to match exactly the transfer of the portion of adhesive strip 7**.

The drive roller 97 drives the rollers 11 of the gluing path via a drive wheel 113, a drive wheel 115 and an interposed chain or cord transmission 117.

The moistening mechanism 90 which is used in FIG. 6 consists of a contact element 119 with a contact tag 121. The advancing adhesive strip 7 forces the contact trigger means 121 aside, thereby switching on a water spray nozzle 123 for a predetermined length of time so as to spray water on to the adhesive strip 7 as it moves past it. Instead of the nozzle 123, it is of course also possible to use a roller (not shown) to perform the moistening operation. As soon as the portion of adhesive strip releases the trigger 121 and, after a predetermined time lag, the spray nozzle 123 is switched off again.

Figure 8:
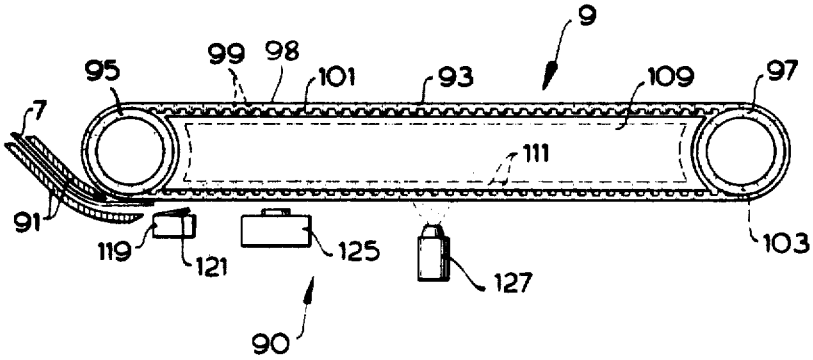
FIG. 8 shows the vacuum conveyor device according to FIG. 6 with a modified damping mechanism.
Figure 9:
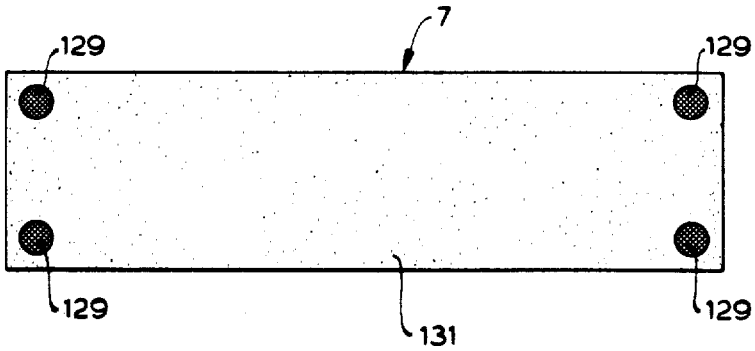
FIG. 9 shows a view of an adhesive strip which has been made capable of adhering with the help of the moistening mechanism according to FIG. 8.

Another form of the moistening mechanism 90 is represented in FIG. 8. Adjacent to the leading or entry portion of the moistening mechanism 90, a contact element 119, senses the entry of a portion of adhesive strip 7, and by means of suitable circuitry (not shown) switches on an applicator appliance 125 for a hot melt adhesive and thereafter an applicator appliance 127 for a wet adhesive. The adhesive strip used in this case is free from any adhesive prior to its entry into the moistening mechanism. This furnishes the special advantage that the adhesive strip can be matched very accurately to the color given to the corrugated board case on to which it is to be glued. After the trigger means 121 has sensed the arrival of the strip, it switches on the applicators 125 and 127; first of all, the applicator 125 is moved toward the conveyor belt by means (not shown) to apply the hot melt adhesive by dabbing it on intermittently to selected spaced portions of adhesive strip. It is to be understood that in lieu of intermittently dabbing on a tacky adhesive in spotted arrangement as shown (FIG. 9), a quick charge of tacky adhesive can also be expelled toward the advancing strip which would make it unnecessary to move the applicator toward and away from the moving strip. In FIG. 9, these tacky portions are denoted by 129. After the application to the portions 129, the whole of the adhesive strip 7 is sprayed with a layer 131 of a wet adhesive. If the portion of the adhesive strip 7 which has thus been prepared touches the corrugated board case, in the zone of the rollers 11, the portions 129 stick the adhesive strip firmly on to the case. The final gluing then takes place with the help of the wet adhesive of the layer 131. By attachment with the help of the portions 129, the adhesive strip can no longer move on the corrugated board case. This is an important advantage compared with wet gluing which has hitherto alone been usual. The positions of the applicator appliances 125 and 127 can if necessary be changed over without any trouble. It is believed that it will be apparent to those skilled in this art that it will be a relatively simple matter to associate the adjustable switch 121 (one shown) with the applicator mechanism 125 and the spray means 127 so that after the presence of the strip 7 is sensed by the trigger means, and allowing for a predetermined delay, the applicator will then apply the first two (or more) spots of adhesive adjacent to the leading edge of strip 7. Then, allowing for the relative spaced positions of the applicator 125 and spray means 127 and compensating for the speed of travel of the strip, the spray means is started. Prior to the trailing end of the strip reaching the position of the applicator 125, this having been sensed by its passage past the trigger means, this applicator will again be caused to apply spots of adhesive adjacent to the trailing end of the strip and then the leading edge of the strip 7, having already arrived at the spray adhesive station, will receive its coating during its travel thereby, and then the spray station will be stopped and, by that time, another strip will have attained a position where its presence will be sensed by the trigger means 121.

What is claimed is:

1. An apparatus for progressively feeding folded blank boxes and a predetermined length of severed strip material to be assembled therewith to an assembly station comprising, a supply source for a traveling length of strip material, first means for advancing a leading edge of said strip to a severing station, back-up means in said station adapted to provide a support surface for the advancing strip, and cutter means arranged to cooperate with said back-up means to permit severing a strip of predetermined length from said traveling length of material, means for advancing said severed strip to a conveyor means, means for activating the severed strip while on said conveyor means to prepare it for attachment to the folded blank box poweroperated braking means are included to stop strip travel to the activation means upon failure of boxes to flow to said conveyor and further means coupled with said first means for advancing said strip to a point of assembly with the blank box and thereafter discharging the box from the apparatus.

2. An apparatus as described in claim 1, wherein the means for activating said strip includes a spray nozzle for applying a mist thereto.

3. An apparatus as described in claim 1, wherein the means for activating said strip includes a means for applying spots of a tacky adhesive to predetermined locations on said strip.

4. An apparatus as described in claim 3, wherein said means for activating said strip further includes a nozzle for applying a mist of wet adhesive to said strip.

5. An apparatus as described in claim 3, wherein said spots are applied by dabbing the adhesive on said strip.

6. An apparatus as described in claim 1, wherein the braking means includes a pressure roller and an electrically actuated brake shoe means for cooperation therewith.

7. An apparatus as claimed in claim 1, wherein said means for activating the severed strip comprises a hot gluing means and a wet gluing means each of which are operated in sequence.

8. An apparatus as claimed in claim 1, in which control means are included to interrupt advance of said strip to said conveyor upon event of an operational fault.

* * * * *